United States Patent [19]

Tacchini

[11] Patent Number: 4,857,038

[45] Date of Patent: Aug. 15, 1989

[54] MACHINE FOR FORMING CARDBOARD BOXES FROM BLANKS FOLDED FLAT

[75] Inventor: Franco Tacchini, Nebbiuno, Italy

[73] Assignee: Comarme Marchetti FASpA, Milan, Italy

[21] Appl. No.: 96,584

[22] Filed: Sep. 15, 1987

[30] Foreign Application Priority Data

Sep. 15, 1986 [IT] Italy ..... 23018 B/86

[51] Int. Cl.[4] ..... B31B 1/78; B31B 5/80

[52] U.S. Cl. ..... 493/316; 493/183

[58] Field of Search ..... 493/123, 124, 125, 183, 493/316

[56] References Cited

U.S. PATENT DOCUMENTS

| | | | |
|---|---|---|---|
| 2,289,820 | 7/1942 | Ardell | 493/316 |
| 3,040,634 | 6/1962 | Galloway | 493/319 |
| 3,451,318 | 6/1969 | Arnaudon et al. | 493/319 |
| 3,608,440 | 9/1971 | Reichert et al. | 493/30 |
| 3,739,696 | 6/1973 | Pearson | 493/178 |
| 4,414,789 | 11/1983 | Pattarozzi | 493/316 |
| 4,498,893 | 2/1985 | Odom | 493/12 |
| 4,627,830 | 12/1986 | Smidt | 493/313 |
| 4,632,666 | 12/1986 | Ulrich et al. | 493/316 |

*Primary Examiner*—Frederick R. Schmidt
*Assistant Examiner*—William E. Terrell
*Attorney, Agent, or Firm*—Cushman, Darby & Cushman

[57] ABSTRACT

A machine is provided for forming three-dimensional cardboard boxes starting from a blank folded flat. The machine has a supporting frame which includes a magazine containing many flat blanks for taking one blank at a time from the magazine. The machine is capable of opening the blank, closing the lower smaller flaps of the blank, closing the lower larger flaps, and ejecting a formed box. The lower smaller flaps are closed virtually simultaneously with the opening of the blank in such a manner so as to prevent interference by the smaller flaps with the adjacent larger flaps and thus facilitate closing of the smaller flaps. The opening mechanism rotates around pins, each located at a corner of a box to be formed. At least one of the rotation pins is adjustable in position. Retractable suction cup members make up the opening mechanism.

10 Claims, 12 Drawing Sheets

MACHINE FOR FORMING CARDBOARD BOXES FROM BLANKS FOLDED FLAT

DESCRIPTION

Figure 1:
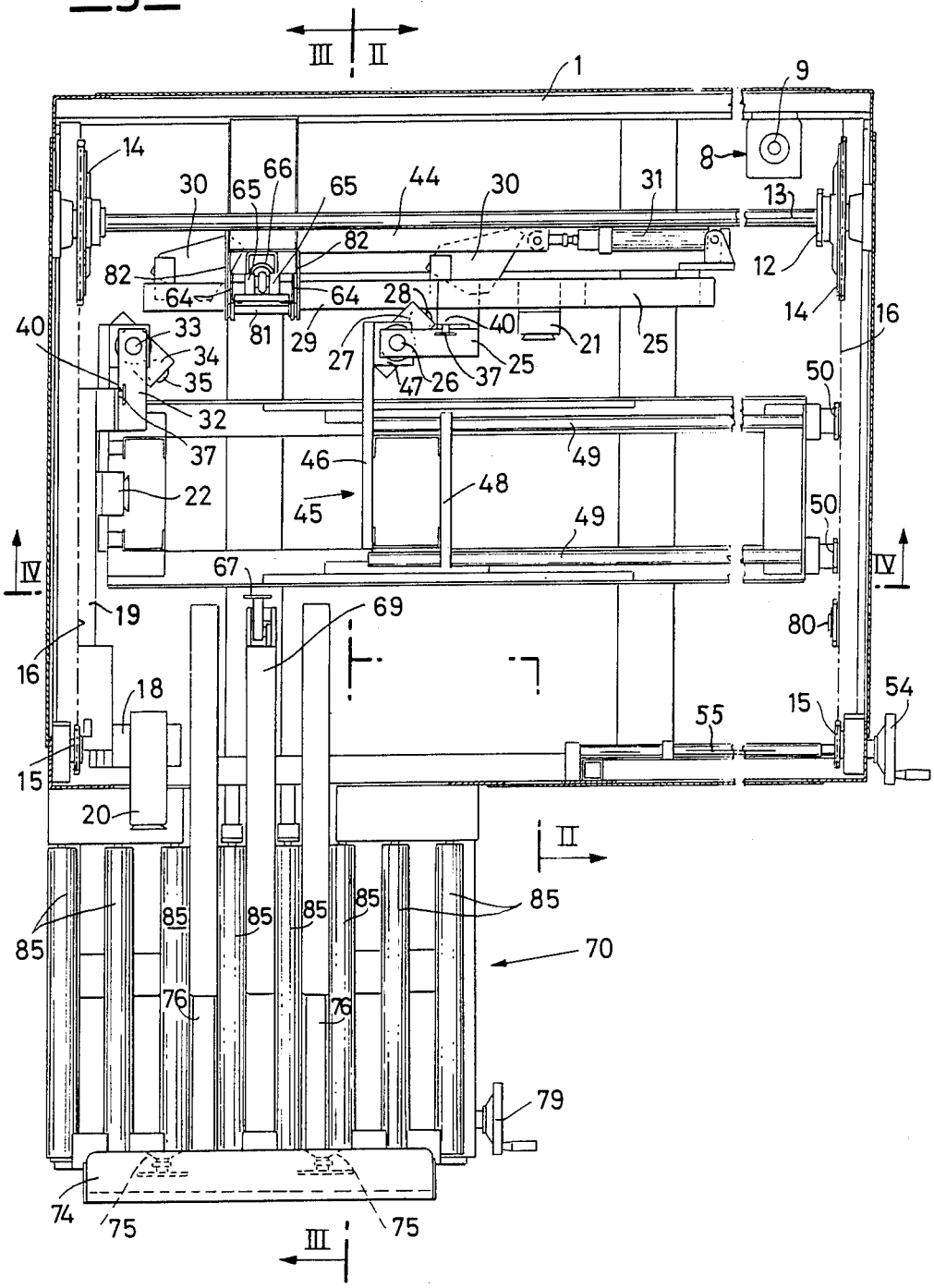

The present invention relates to a cardboard box forming machine.

Numerous cardboard box forming machines are known in the art. Said forming machines comprise a magazine containing a plurality of blanks folded flat, means for withdrawing from said magazine one blank at a time, means for opening and squaring said blank, means for closing the lower end flaps or smaller flaps and means for closing the lower side flaps or larger flaps.

Examples of said machines are described in U.S. Pat. Nos. 3,608,440 and 3,739,696.

In U.S. Pat. No. 3,608,440 there is described a machine equipped with suction cups as members for withdrawing and opening a blank placed in a magazine. Said suction cups grasp the blank along opposite sides and, with a mutual withdrawal movement of the suction cups, the blank is opened and squared.

In a subsequent step means for closing the smaller flaps operate and then the box advances to a second zone in which is applied glue to the edges of the larger and smaller flaps and sealing thereof is performed.

In U.S. Pat. No. 3,739,696 describes a machine in which there are provided suction cups designed to withdraw and open a blank by acting along its opposite sides and means designed to fold the front and rear smaller flaps. The folding means for the rear flap operate during the opening of the blank while the means for closing the front flap operate later when the box advances to a subsequent work station.

The major drawback met with in machines of this type is due to the difficulties of closing the smaller flaps, the side edges of which can easily interfere with the side edges of the two larger flaps. It is mentioned that if during the opening movement of the blank the larger flaps are slightly inclined toward the interior of the box the subsequent closing of the smaller flaps is made difficult or is even prevented.

Considering this state of the art the object of the present invention is to achieve a cardboard box forming machine in which the folding of the smaller flaps of said blank is performed effectively without interference by said smaller flaps with said larger flaps.

In accordance with the invention said object is achieved by making a cardboard box forming machine having a supporting frame and comprising a magazine containing a plurality of flat-folded blanks, means for withdrawing one blank at a time from said magazine, means for opening said blank, means for closing the lower smaller flaps of the blank, means for closing the larger lower flaps and means for ejecting a formed box characterized in that said closing means for the smaller flaps are activated simultaneously with said opening means of said blank to fold and close said lower smaller flaps while the blank is being opened.

With such an arrangement, since the folding of the smaller flaps begins when they are still parallel with the larger flaps, no interference occurs between the adjacent edges of said flaps.

Said opening means are also arranged in such a manner as to engage opposite walls of the blank and performs the opening thereof by rotating around pins each located in a position adjoining an edge of the box to be formed so that the opening means which engage a first wall of the blank and the opening means which engage the opposite wall exert simultaneously rotation forces which allow the box to open perfectly and free of difficulties for the structure of the box.

The additional advantage obtained is to considerably reduce the space occupied by the machine since the opening and squaring as well as the closing of the lower smaller flaps take place in a single work station, thus eliminating conveyance of the box to other zones or stations of the machine.

Figure 2:
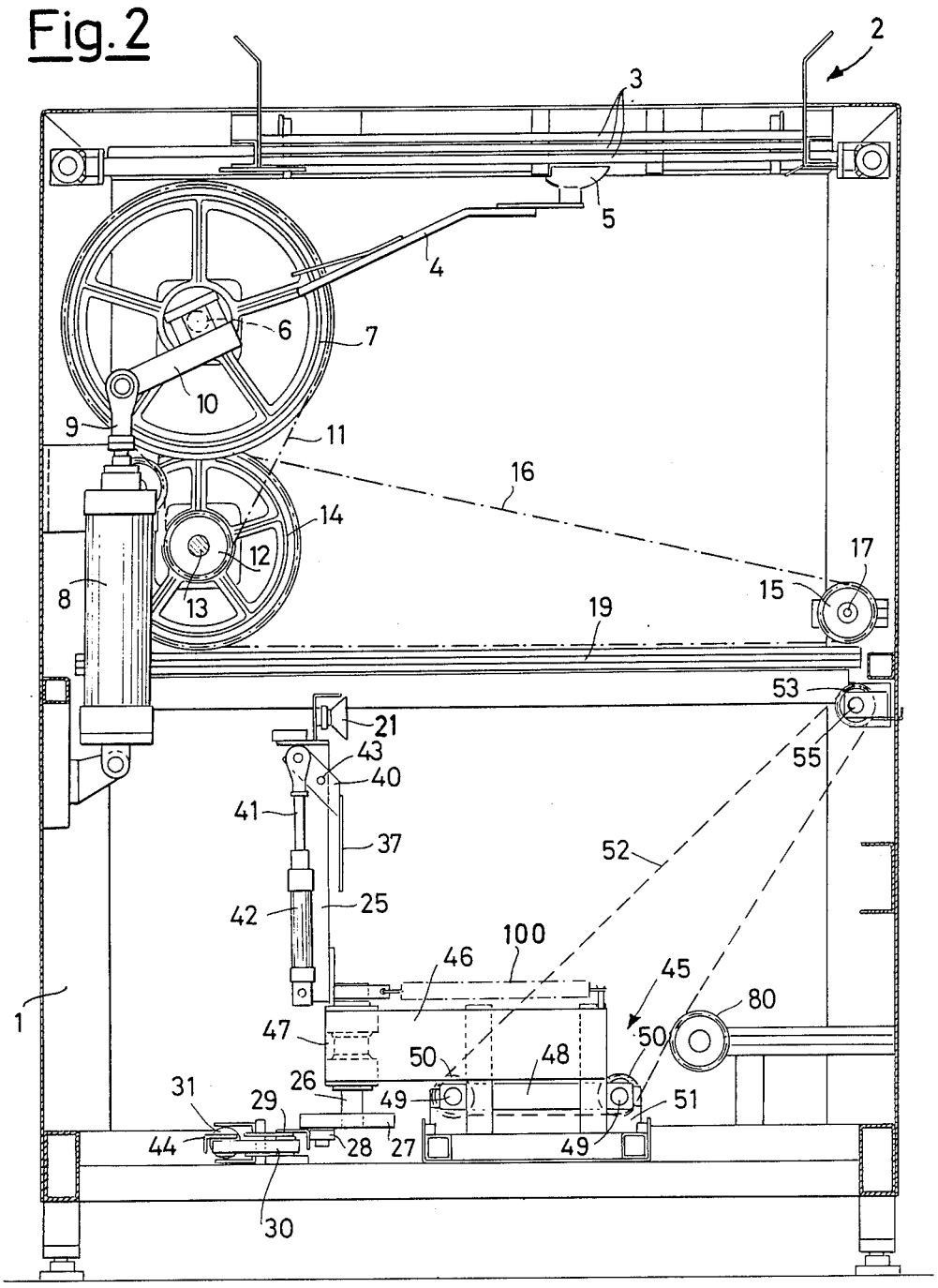
Figure 3:
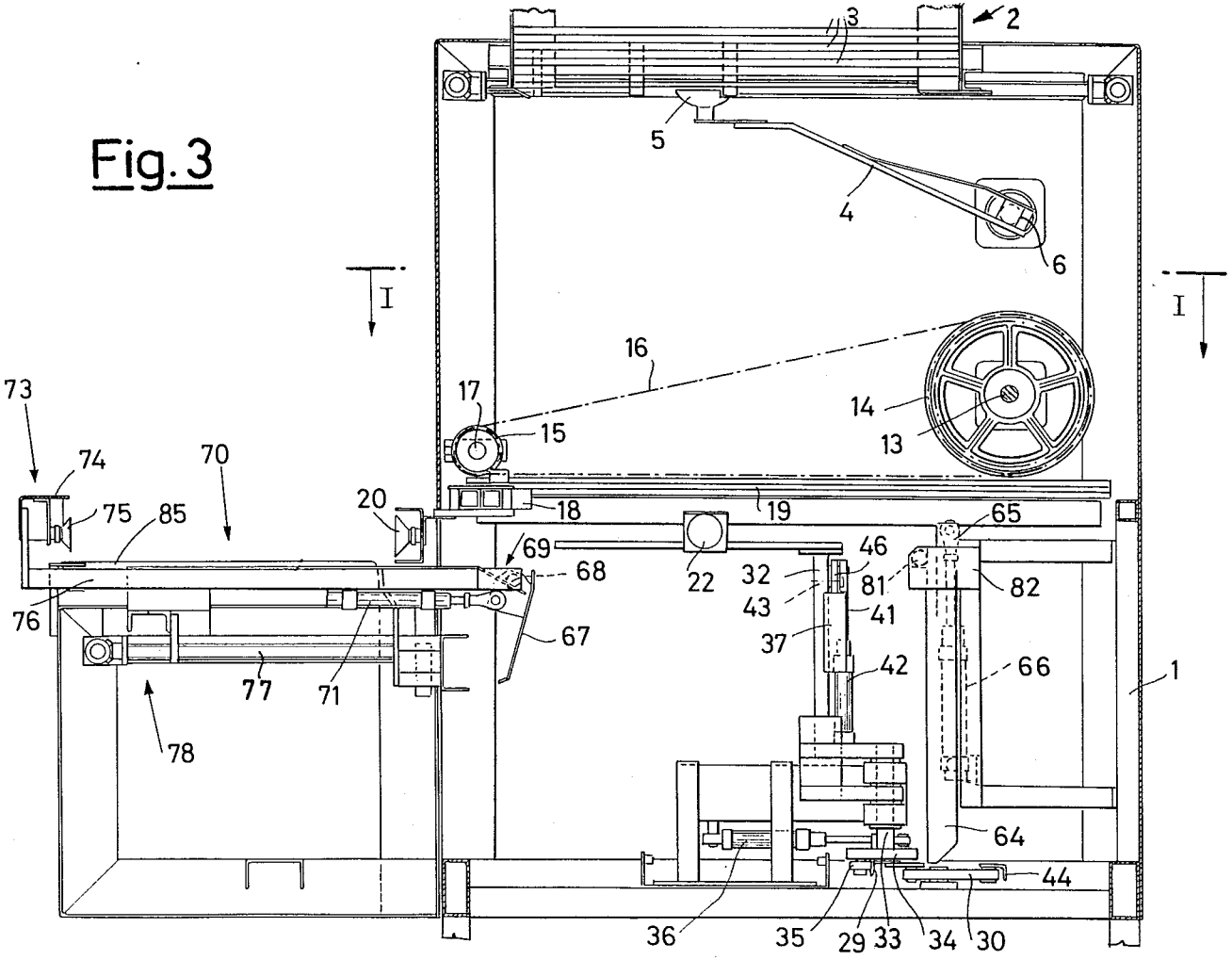
Figure 4:
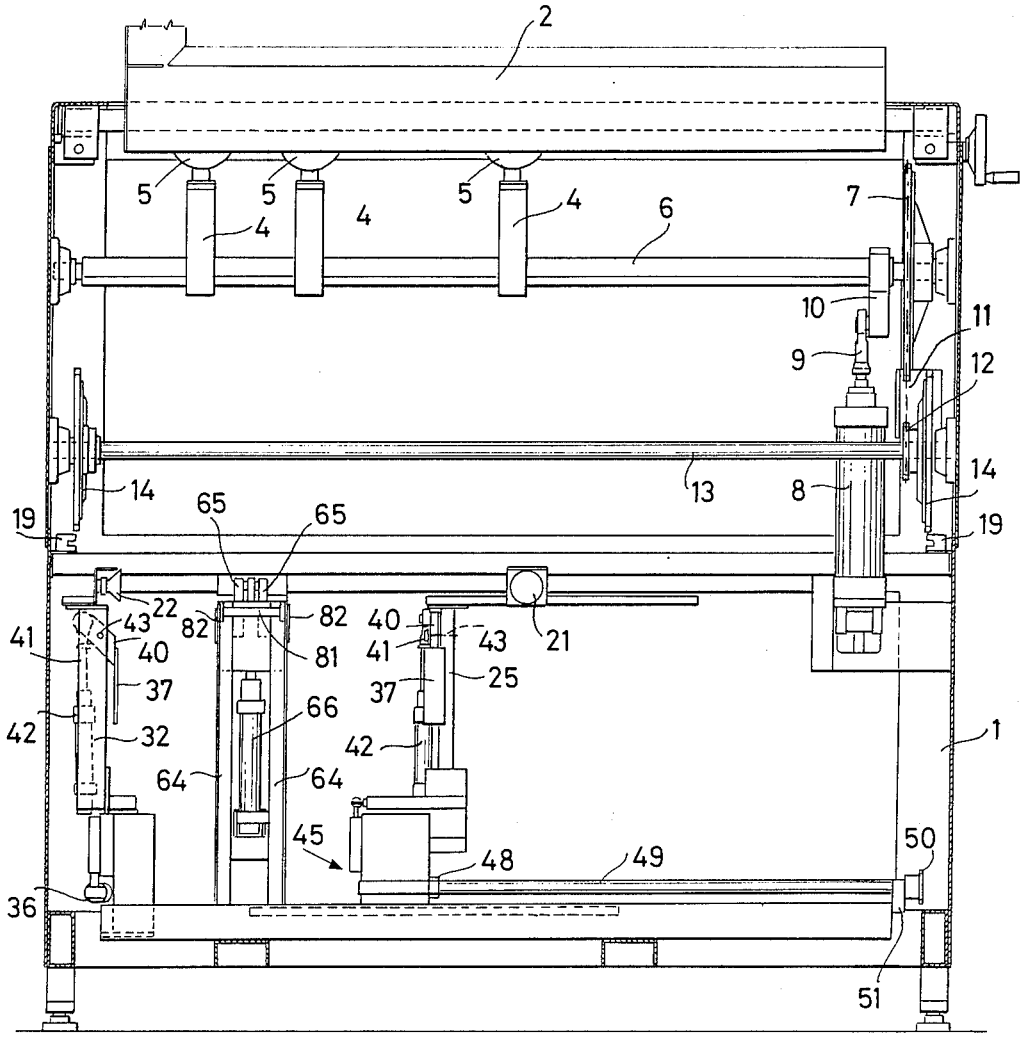
Figure 5:
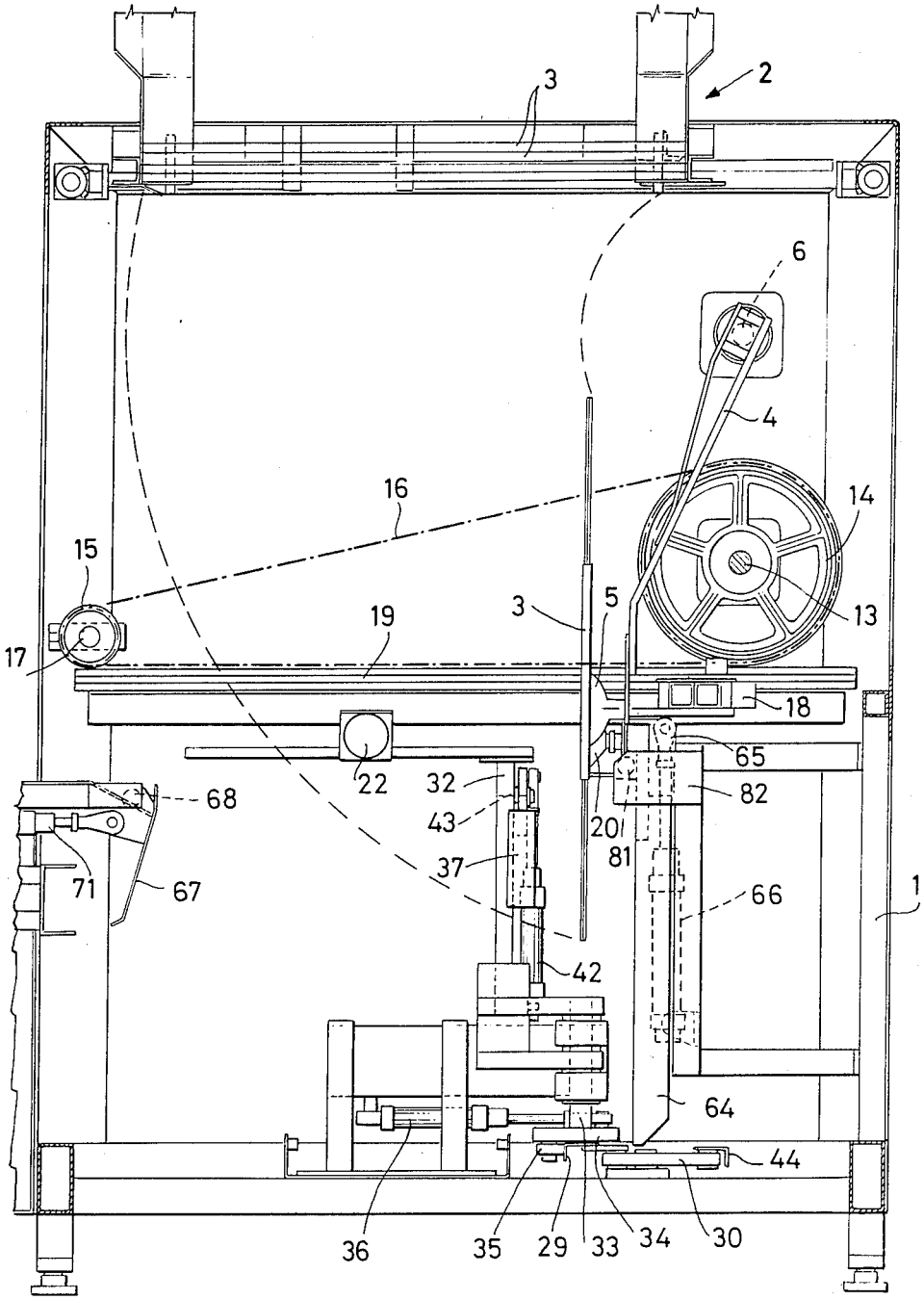
Figure 6:
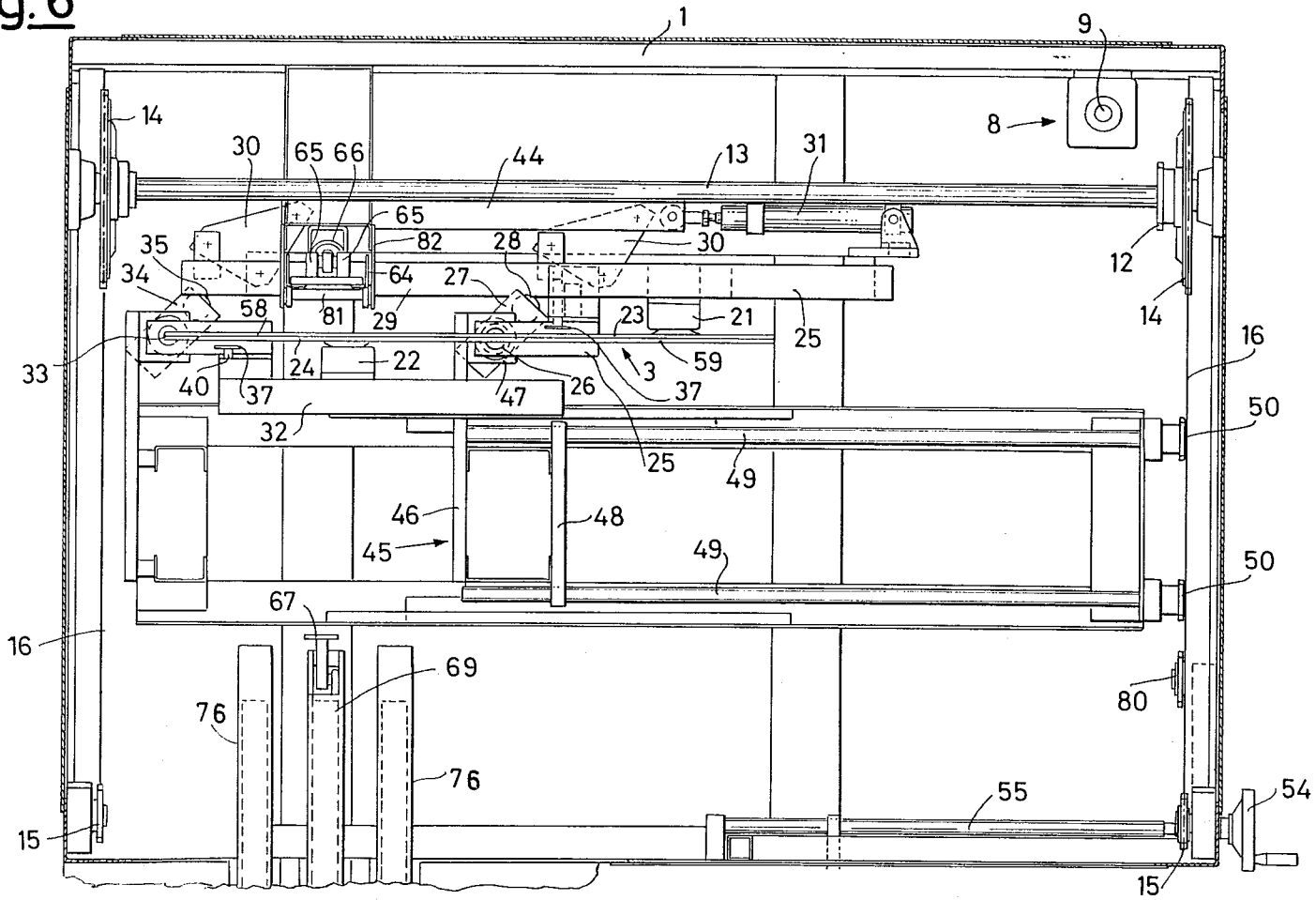
Figure 7:
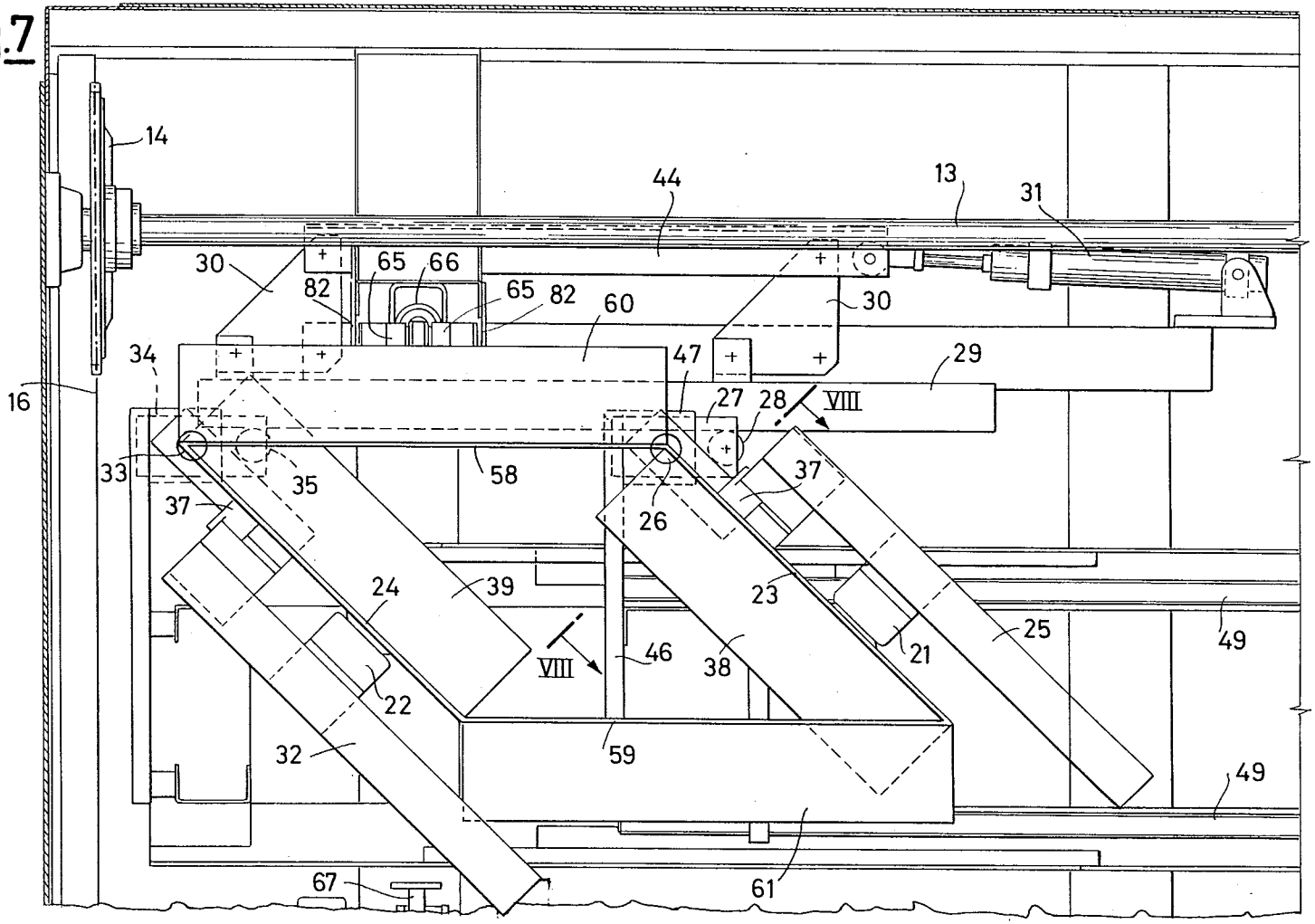
Figure 8:
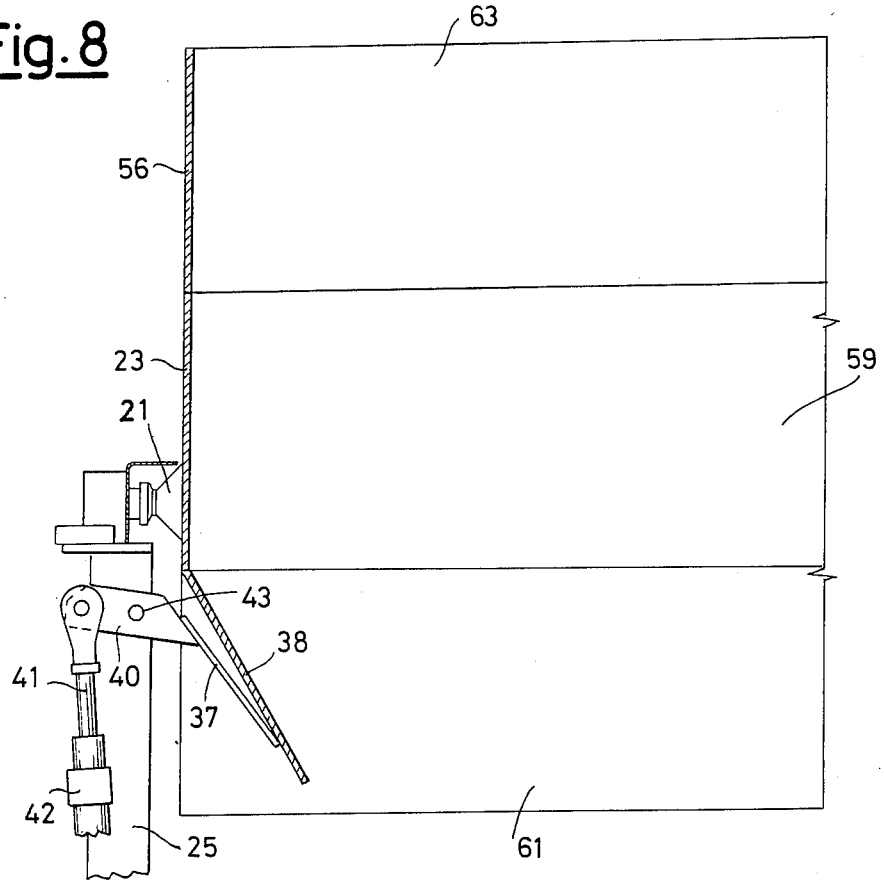
Figure 13:
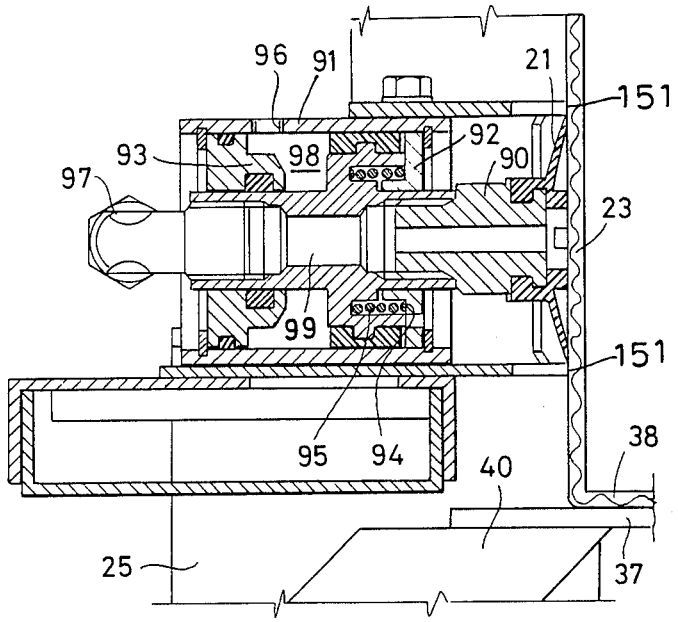
Figure 9:
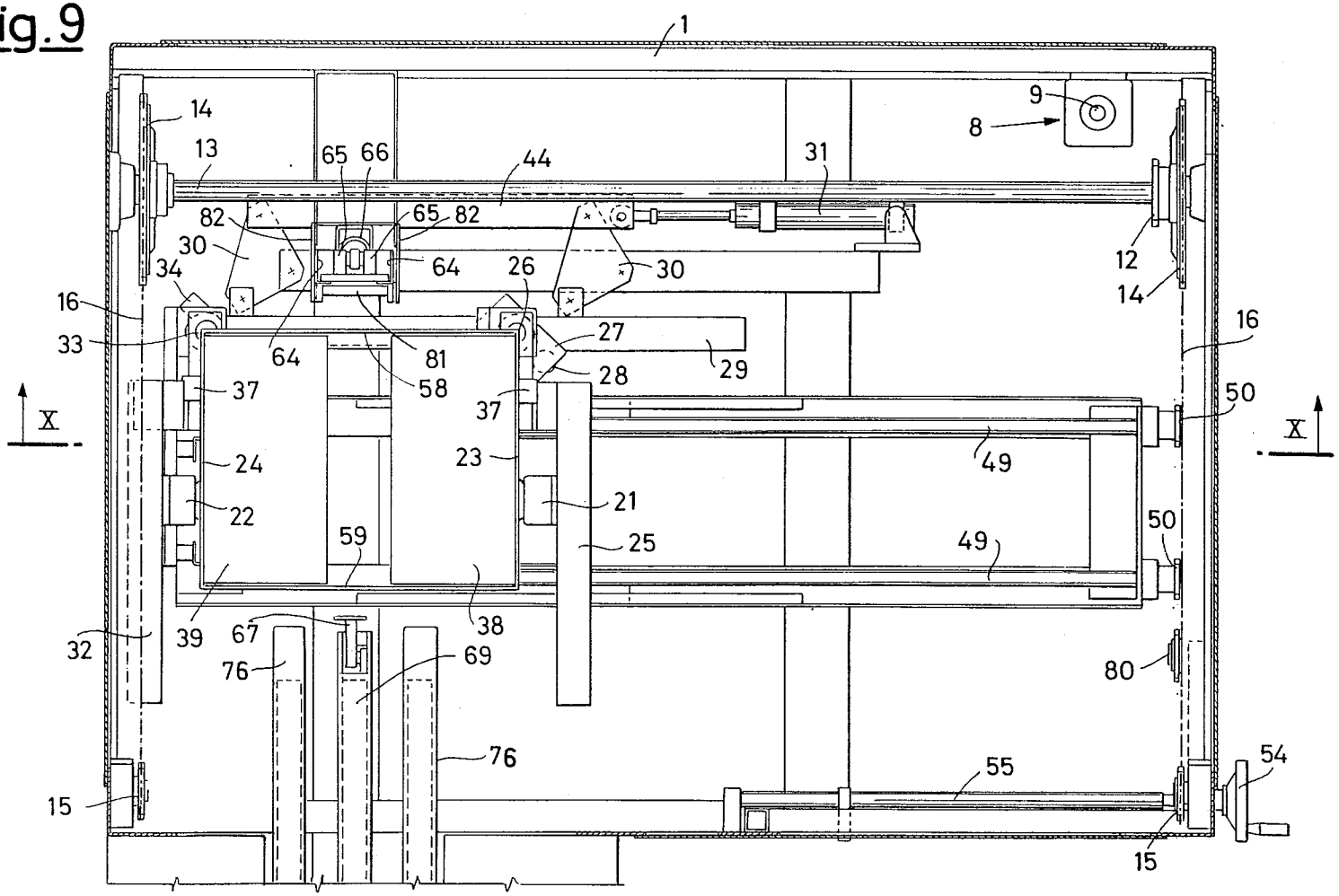
Figure 10:
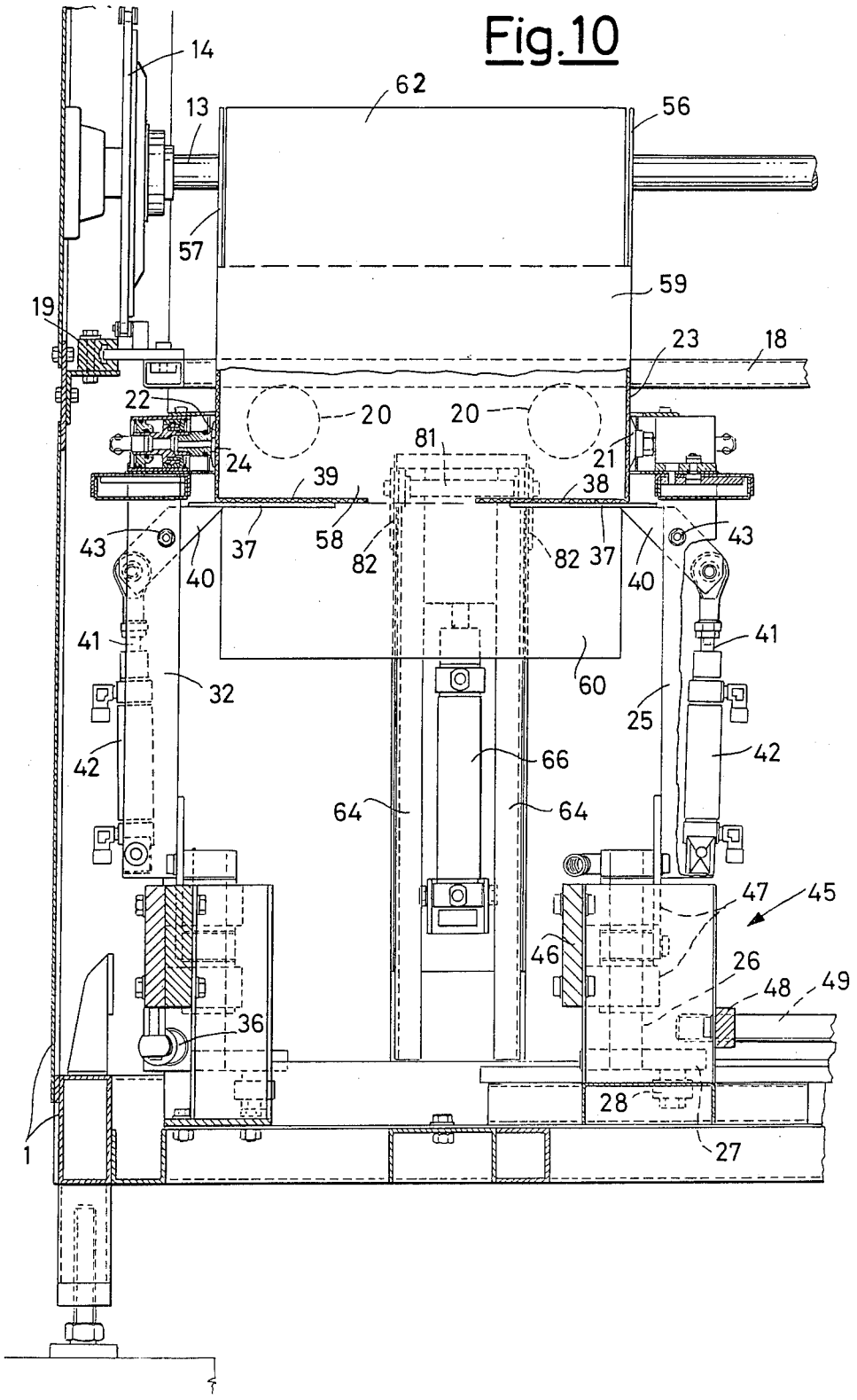
Figure 11:
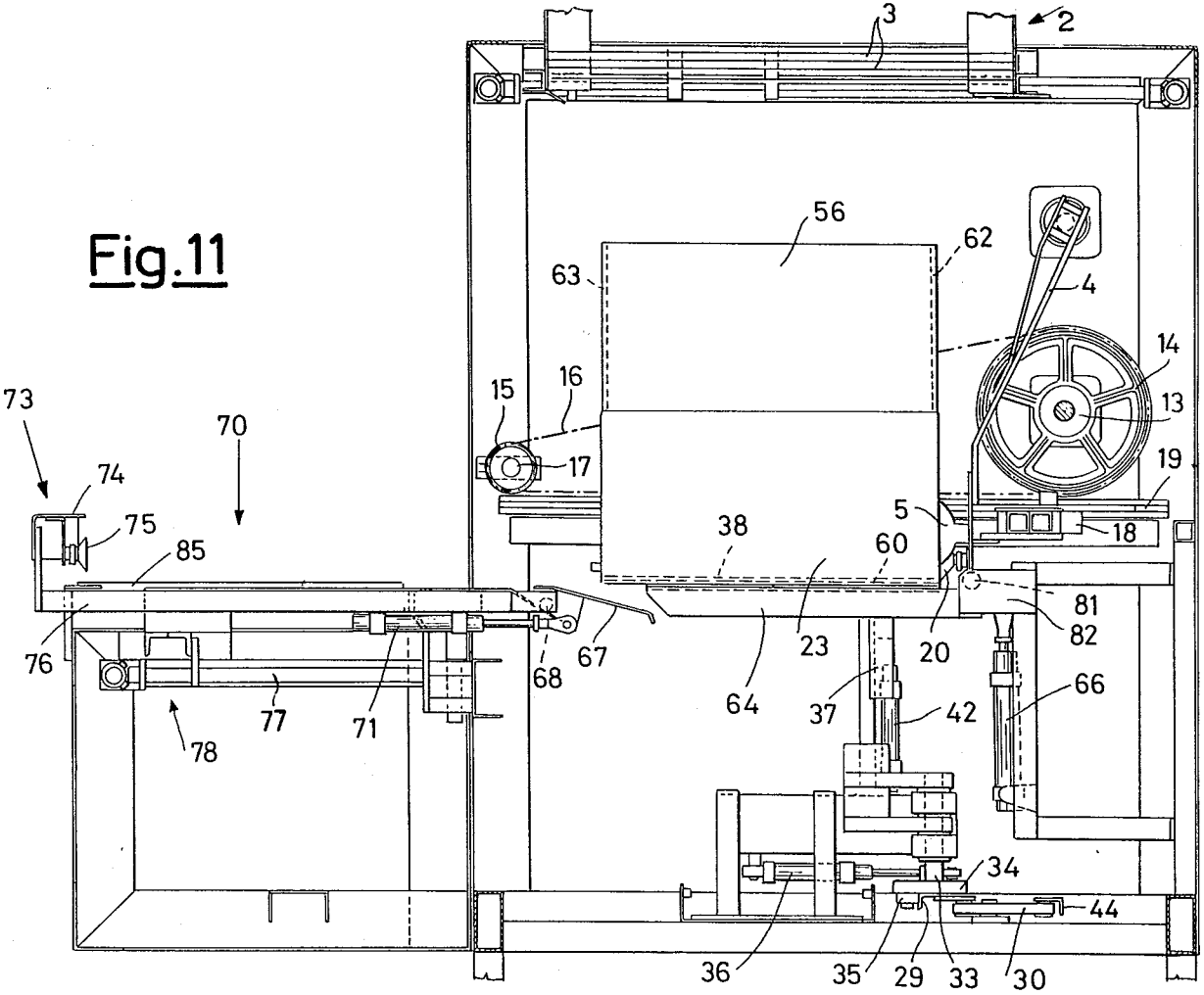
Figure 12:
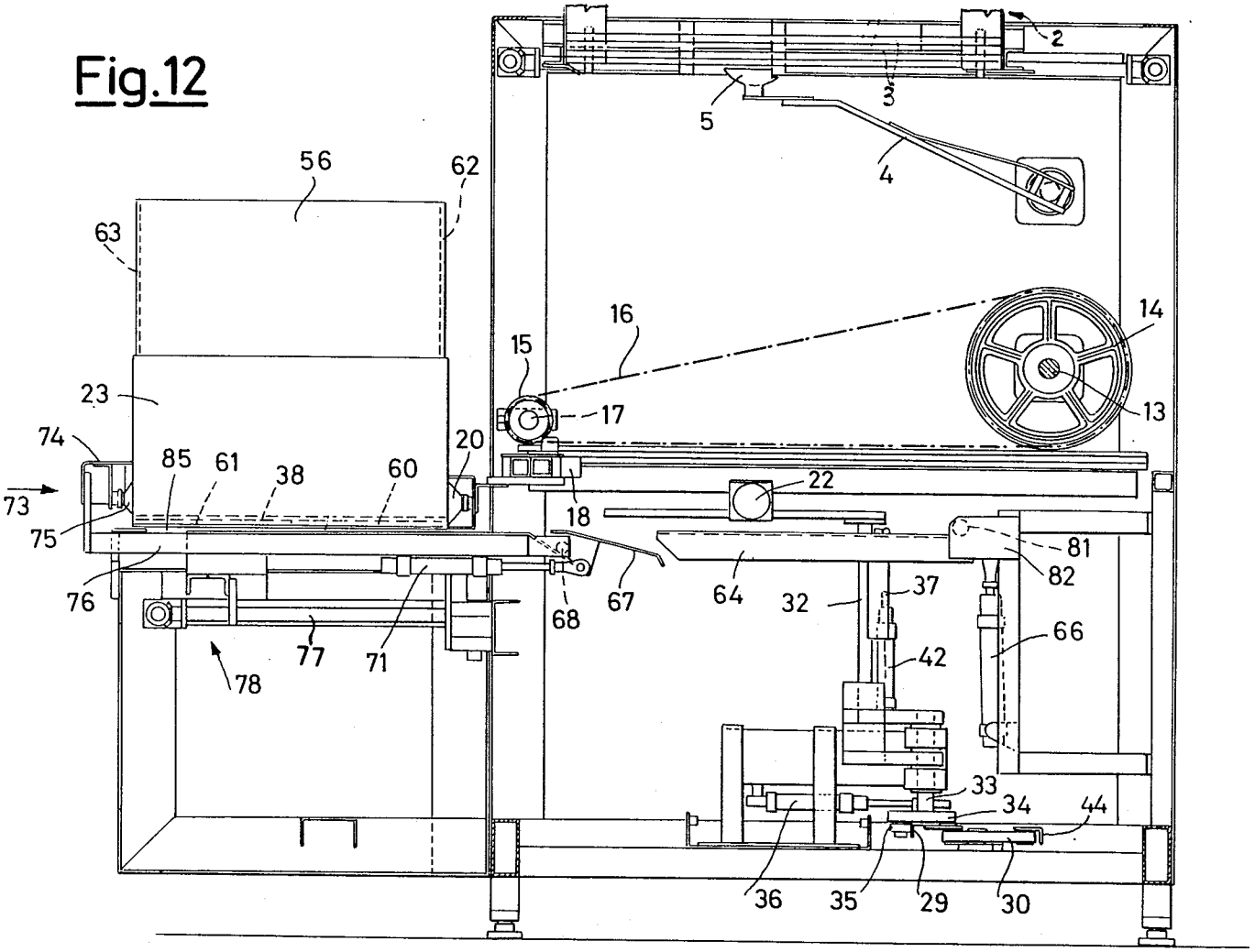

A possible form of practical embodiment of the present invention is illustrated by way of a nonlimiting example in the annexed drawings wherein:

FIG. 1 shows a horizontal cross section along line I—I of FIG. 3 of a cardboard box forming machine in accordance with the invention, FIG. 2 shows a vertical cross section of said machine along line II—II of FIG. 1, FIG. 3 shows a vertical cross section of said machine along line III—III of FIG. 1, FIG. 4 shows a vertical cross section of said machine along line IV—IV of FIG. 1, FIGS. 5, 6 and 7 show the first operating phases of the process of preparation of the cardboard box in said machine, FIG. 8 shows a cross section of a detail along line VIII—VIII of FIG. 7, FIG. 9 shows another step in the preparation of a box, FIG. 10 shows a cross section along line X—X of FIG. 9, FIGS. 11 and 12 show the final phases of the preparation of a box, and FIG. 13 shows an enlargement of a detail of a means for opening the box cross-sectioned as in FIG. 10.

With reference to FIGS. 1, 2, 3 and 4 there is shown a cardboard box forming machine comprising a support frame 1 equipped with a magazine 2 for containing a plurality of blanks 3 arranged one upon the other and folded flat.

The machine includes arms 4 (FIGS. 2 and 3) equipped at one end with suction cups 5 and joined at the other end to a shaft 6 induced to rotate in alternating directions by a compressed air piston 8 the rod 9 of which is united with said shaft 6 by a lever 10.

The shaft 6 bears a sprocket 7 connected by a first chain 11 to a second sprocket 12 which is supported by a shaft 13 on which are keyed two sprockets which in turn drive through chains 16 another pair of sprockets 15 supported by hubs 17 integral with the frame 1 (FIGS. 2 and 3). As shown in FIG. 3 said chains 16 entrain a cursor 18 which slides in lateral guides 19 and is equipped with a plurality of suction cups 20. Said cursor 18, translating forward and backward, ejects the formed boxes as will be described in greater detail below.

The forming machine is equipped with suction cups 21 and 22 designed to adhere to the opposing smaller side walls 23 and 24 of the blank 3 to which are joined the lower smaller flaps 38 and 39 and upper smaller flaps 56 and 57 (FIGS. 6 and 7). The larger side walls 58 and 59 of the blank 3 are equipped with lower larger flaps 60 and 61 and upper larger flaps 62 and 63 (FIGS. 9, 10 and 11).

Specifically the suction cup 21 (FIG. 4) which goes to adhere to the wall 23 is supported by a first turning arm 25 whose rotation pin 26 positioned next to an edge of the formed box is integral with a lever 27 equipped with a roller 28 which works with a first bar 29 on which are hinged plates 30 which in turn have their fulcrum on a second bar 44 connected to a compressed air piston 31 (FIGS. 1 and 2). A recall spring 100 (FIG. 2) stresses the arm 25 in a neutral position.

The suction cup 22 (FIG. 3) which goes to adhere to the wall 24 of the blank is supported by a second turning arm 32 whose rotation pin 33 is integral with a lever 34 equipped with a roller 35 which works with the bar 29 driven by the compressed air piston 31 (FIG. 1).

A compressed air piston 36 (FIG. 3) acts on said lever 34 to take said suction cup 22 into contact with the blank to be opened.

As can be seen in FIGS. 1 to 4, the turning arms 25 and 32 are equipped with a folding element 37 consisting of a blade designed to engage and fold the lower smaller flaps 38 and 39 of the blank 3. Each folding element 37 is integral with an arm 40 which is connected in an articulated manner to the end of the stem 41 of a compressed air piston 42 and can rotate around a pin 43 provided in each of said turning arms 25 and 32.

Each suction cup 21 and 22 is connected to a compressed air system which creates the necessary vacuum to cause said suction cups to adhere to the surface of the blank.

As shown in detail in FIG. 13 the suction cup 21 or 22 is applied to one end of a hollow body 90 which slides horizontally in a housing 91 which is fixed to the turning arm 25 or 32 and defines abutments 151 for the adjacent carton wall 23 or 24. In the housing 91 a front stop 92 and a rear stop 93 are included whose distance determines the travel of the hollow body 90 within said housing. Between the hollow body 90 and the housing 91 there is provided a ring-like cavity 98 which surrounds said hollow body 90 and is in communication with the exterior through an opening 96. The internal passage 99 of the hollow body 90 is connected by means of an attachment 97 at the end opposing that to which is applied the suction cup to a means (not shown) designed to create a vacuum in the suction cup. Said hollow body also describes in combination with said front stop 92 a seat 94 for a recall spring 95 which withdraws the suction cup to a neutral position.

To activate the suction cup, air under pressure must be let into the cavity 98 through the opening 96. The pressure exerted by the air induces the hollow body 90 to compress the spring and to advance to the front stop 92 carrying the suction cup beyond the abutments 151 and into contact with the blank. Simultaneously there is created in the suction cup a vacuum such as to secure adhesion between the blank and said suction cup. When it is necessary to disactivate the suction cup, the supply of compressed air in the cavity 98 and the vacuum are interrupted; the recall spring 95 then returns the suction cup to the neutral position pushing the hollow body against the rear stop 93 the abutments 151 are thus left free to contact the adjacent carton wall.

For correct opening of the blank 3 the rotation pins 26 and 33 of the arms 25 and 31 must be separated by a reciprocal distance equal to the length of the greater side of the blank 3.

To adapt the forming machine to blanks of different dimensions there is provided a system of variation of the distance between said pins 26 and 33.

Said system comprises a carriage 45 equipped with a side support 46 integral with a sleeve 47 which fits over the pin 26 of the first arm 25. The carriage 45 consists of a cursor equipped with threaded holes in which are screwed long worm screws 48 integral with sprockets 50 placed at one end thereof and supported by a suitable support 51 (FIGS. 1, 2 and 4). The sprockets are connected by a chain 52 to another sprocket 53 (FIG. 2) driven by a crank 54 and supported by a shaft 55 (FIG. 1). The chain 52 is sufficiently stretched by means of a chain stretching gear 80. By moving the carriage 45 by means of the worm screws 49 the sleeve 47 fitted over the pin 20 is caused to traverse and with it the entire assembly consisting of the arm 25, the related suction cup 21 and the folding element 37 of the smaller flap 38.

To close the lower larger flaps 60 and 61 there are provided a first and a second means which operate immediately after closing of the smaller flaps 38 and 39 respectively and before ejection of the box.

Said first means consists of a section bar 64 connected by a lever 65 to a compressed air piston 66 and hinged inside supports 82 united to the frame 1 and connected by a roller 81 working with said section bar 64.

Said second means consists of a plate 67 hinged at 68 to a protruding portion 69 of an ejection bench 70 for the boxes formed and connected to a compressed air piston 71 designed to produce the alternating rotation of said plate 67 around the pin 68.

On the bench 70 equipped with a plurality of idling rollers 85 is provided a stop member 73 for an ejected formed box, which member 73 is preferably in the form of a horizontal bar 74 equipped with at least one pair of suction cups 75, said horizontal bar 74 being adjustable in position to adapt itself to boxes of different sizes. For this purpose said bar 74 is integral with a pair of sliding rods 76 which are connected to a handling unit 78 (FIG. 3) associated with adjusting screws 77 driven by a crank 79 (FIG. 1).

The forming machine described is designed to operate as follows.

Referring to FIG. 3 the forming machine described is shown in the initial position of the forming sequence of a box. In this condition the arms 4 are rotated in such a manner that the suction cups 5 are in contact with a blank 3 placed on the bottom of the magazine 2. In addition the ejection suction cups 20 are in a forward position at the inlet of the ejection bench 70. By activating the compressed air piston 8 rotation of the shaft 6 is induced through the lever 10, causing lowering of the arms 4 whose suction cups 5 take a blank 3 from the bottom of the magazine 2 (FIG. 5).

During this rotation of the arms 4 the sprocket 7 induces rotation of the sprockets 14 and 15, whose connecting chain causes sliding of the cursor 18 supporting the suction cups 20 along the guides 19 away from the bench 70 so that when the arms 4 are in the position rotated downward of FIG. 5 the ejection suction cups 20 have arrived at a backward position beside the suction cups 5 of said arms 4 (FIG. 5). The blank 3 will be disposed with the smaller wall 23 against the suction cup 21 and with the adjacent larger side wall 58 against the suction cups 20. At this point the compressed air piston 36, acting on the lever 34, induces rotation of the turning arm 35 supporting the suction cup 22, which thus goes to adhere to the smaller wall 24 (FIg. 6).

In FIGS. 6, 7 and 9 for greater drawing clarity the suction cups 5 of the arms 4 and the ejection suction cups 20 along the walls 23 and 58 of the blank have been omitted.

As shown in FIG. 7 the opening of the blank 3 and the folding and closing of the smaller flaps 38 and 39 are performed at the same time.

This operation is performed by the compressed air piston 31 which causes sliding of the second sectional bar 44 which in turn by means of the plates 30 causes traversing of the first sectional bar 29. The latter engages the rollers 28 and 35 of the levers 27 and 34 respectively, forcing the arms 25 and 32 to rotate around their respective pins 26 and 33, opening the blank. The suction cup 21 exerts a force of attraction on the wall 23 and the suction cup 22 exerts a force of attraction on the wall 24. Simultaneously with the opening of the blank, i.e. with the rotation of the arms 25 and 32, there are made to operate the compressed air pistons 42 whose rods 41 are each hinged to an arm 40 connected at its fulcrum 43 to their respective turning arms 25 and 32, the arm 40 being integral with the folding element 37 designed to exert thrust on the flap to be folded and closed (FIg. 8).

At the end of the rotation of the turning arms 25 and 32 the blank appears as shown in FIGS. 9 and 10 completely open and with the smaller flaps 38 and 39 completely open and with the smaller flaps 38 and 39 perfectly folded and closed.

There then ensues the closing step of the lower larger flaps 60 and 61. The larger flap 61 is partially closed first by the lever 67 driven by the piston 71 and then the above closing of the flap 61 is completed simultaneously with the closing of the flap 60 by means of the sectional bar 64 which is rotated by the piston 66.

While the lever 67 begins to rise and slightly incline the flap 61 in closing direction the folding elements 37 acting on the compressed air pistons 42 are lowered. Said return to the neutral position of the folding elements 37 is performed before they interfere with the flap 61, which, being slightly inclined, prevents reopening of the smaller flaps 38 and 39 just closed.

The bar 64 rotates until it encounters the stop roller 81 coinciding with a horizontal position under the box almost formed (FIG. 11).

At this point the compressed air piston 8 is reactivated and rotates in the reverse direction the shaft 13, bringing the arms 4 back to the starting position and causing traversing of the cursor 18 toward the bench 70, thus pushing the box, which completes closing of the flap 61, against the suction cups 75 of the stop 73 appropriately positioned on said bench 70; in this step the suction cups 21 and 22 are returned to the retracted position to avoid possible damage to the box.

The sequence then starts over while the box just formed and ejected is conveyed to a filling station by shifting perpendicularly to the plane of the FIG. 12 sheet using for this purpose means of movement not shown in the drawings.

I claim:

1. A carton erecting machine comprising:

a support frame;

a magazine for containing a vertical stack of flattened carton blanks;

means for picking up the lowest blank of the stack and putting it vertical in a pre-opening position;

carton opening means including first and second grasping means relatively movable from a carton grasping position, in which said first and second grasping means are arranged in parallel vertical planes and engageable with opposite portions of the blank in the pre-opening position which correspond to a first pair of opposite walls of the desired erected carton, to a carton opening position in which said first and second grasping means are arranged in parallel spaced vertical planes to keep the carton in open position;

means for closing a first pair of lower carton flaps depending from a second pair of opposite walls of the erected carton during movement of said grasping means to said carton opening position;

means for closing a second pair of lower carton flaps depending from said first pair of opposite side walls of the erected carton after the end of movement of said grasping means; and carton ejecting means for finally moving the erected carton perpendicularly to said second pair of side walls to a carton delivering position.

2. A machine according to claim 1, further comprising first and second support arms for carrying said first and second grasping means respectively, said first and second support arms being arranged for rotation about pivot axes close to respective lateral ends of one of said second opposite side walls of the erected carton.

3. A machine according to claim 2, further comprising means for adjusting the position of at least one of said pivot axes.

4. A machine according to claim 2, wherein said means for closing a first pair of lower carton flaps comprise levers rotatably mounted on said support arms and means for driving said levers operated during movement of said grasping means from the carton grasping position to the carton opening position.

5. A machine according to claim 2, wherein said means for closing a second pair of lower carton flaps comprises levers rotatably supported by the support frame in opposite portions suitable for engagement with said second pair of lower carton flaps with the carton in said carton opening position.

6. A machine according to claim 2, wherein said first and second grasping means comprise air suction cups.

7. A machine according to claim 6 further comprising a hollow body, each of said air suction cups being arranged at one end of said hollow body, said hollow body being moveable from an advanced working position to a withdrawn rest position with respect to carton abutting portions of a housing fixed to a respective one of said support arms.

8. A machine according to claim 1, wherein said means for picking up the lowest blank comprise air suction cups carried by support arms connected to a common rotating shaft operated by driving means.

9. A machine according to claim 1, wherein said carton ejecting means comprise further grasping means carried by a sliding cursor movable between a backward position, in which said further grasping means are engageable with a blank portion corresponding to a rear wall of said second pair of side walls, to a forward position in which said further grasping means are disengageable from said blank portion of abandoning the carton in ejected position.

10. A machine according to claim 9, wherein said further grasping means consist of air suction cups.

* * * * *